US008500057B2

(12) United States Patent
Åkerlund et al.

(10) Patent No.: US 8,500,057 B2
(45) Date of Patent: Aug. 6, 2013

(54) METHOD AND APPARATUS FOR THREADING A FIBROUS MATERIAL WEB IN A WINDER

(75) Inventors: Kenneth Åkerlund, Helsinki (FI); Mikko Veijalainen, Helsinki (FI); Antti Kylä-Rekola, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 280 days.

(21) Appl. No.: 13/086,236

(22) Filed: Apr. 13, 2011

(65) Prior Publication Data

US 2012/0091248 A1 Apr. 19, 2012

(30) Foreign Application Priority Data

Apr. 15, 2010 (DE) ..... 10 2010 027 820

(51) Int. Cl.
*B65H 18/14* (2006.01)

(52) U.S. Cl.
USPC ..... 242/542; 342/542.1; 342/542.2; 342/542.3; 342/542.4; 342/532.2

(58) Field of Classification Search
USPC ..... 242/542, 542.1–542.4, 532.2, 532.7
See application file for complete search history.

(56) References Cited

U.S. PATENT DOCUMENTS 4,345,722 A * 8/1982 Kuhn ..... 242/527.4
4,370,193 A * 1/1983 Knauthe ..... 242/527.2
4,601,441 A * 7/1986 Oinonen et al. ..... 242/527.3
4,635,867 A * 1/1987 Kytonen ..... 242/527.2
5,386,950 A * 2/1995 Abt ..... 242/532
7,458,539 B2 * 12/2008 Haven et al. ..... 242/532

FOREIGN PATENT DOCUMENTS

JP 02-243449 A 9/1990
JP 04-341445 A 11/1992
JP 2002249266 A 9/2002
JP 2008024393 A 2/2008

OTHER PUBLICATIONS

Search Report for corresponding Austrian patent application dated Jan. 15, 2013.

* cited by examiner

*Primary Examiner* — Sang Kim
(74) *Attorney, Agent, or Firm* — Stiennon & Stiennon

(57) ABSTRACT

A method of adhesive-free threading of a fibrous material web for winding around a winding body includes the steps of diverting the fibrous material web in the circumferential direction of the winding body, guiding the fibrous material web with its unfolded leading edge ahead in the direction of a nip formed between the winding body and a drum and catching the leading edge of the fibrous material web by interaction with the fibrous material web and/or the winding body. An apparatus for adhesive-free threading of a fibrous material web for winding around a winding body has a diverting device for diverting the fibrous material web in the circumferential direction of the winding body and a mechanical guide for guiding the fibrous material web with its unfolded leading edge ahead in the direction of a nip formed between the winding body and a drum.

28 Claims, 2 Drawing Sheets

METHOD AND APPARATUS FOR THREADING A FIBROUS MATERIAL WEB IN A WINDER

CROSS REFERENCES TO RELATED APPLICATIONS

This application claims priority on German Application No. DE 102010027820 filed Apr. 15, 2010, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and an apparatus by which a thick fibrous material web can be threaded into a winder. The invention is especially directed to winding thick fibrous material webs, e.g. pulp webs. The thickness of said thick fibrous material webs amounts to more than 0.5 mm and especially more than 0.7 mm.

Winders or reels are used to wind a fibrous material web and to transport, store or supply it to further processing in said wound state. During winding the fibrous material web is wound around a core which is rotated and around which the fibrous material web is wound.

Such winder or reel is frequently employed together with a cutting device in which the fibrous material web is cut to the width to be supplied, wherein in this case usually cores cut to length corresponding to the web cuts' widths are used onto which the web cuts simultaneously arriving from the cutting means are synchronously wound in the winder.

The cores are very quickly fully wound especially in the case of thick fibrous material webs so that the cores have to be exchanged. After the exchange the web cuts or else the entire web has to be joined to the cores as winding starts so that then winding can be performed in the usual way by rotating the core or the cores.

From the state of the art according to U.S. Pat. No. 7,458,539 a winder is known in which a fibrous material web is to be wound around a core located on two bearer drums in a winding bed and forming respective nips with the two bearer drums.

The web to be wound is guided with its leading edge ahead coming from below through one of the nips to the core and there the leading end of the web is bonded to the core by a double-sided adhesive tape. To this end, a scraper scrapes the web leaving the nip from the bearer drum, the scraper element then making a tilting movement so as to press by a surface the leading end of the web against the core at the position where the adhesive tape is provided. For this solution an adhesive tape is required, however.

Furthermore, a state of the art is known which does not require an adhesive bonding of the leading end. A core is supported on two bearer drums in a winding bed and forms respective nips with the two rollers. The web to be wound is guided from above through the first one of the two nips, moves beneath the core and then passes the other nip. The leading end of the web leaving the nip is caught by a baffle plate and moves along the baffle plate until the latter is covered by the leading end of the web on the side where the first nip is provided.

The baffle plate is now swiveled in the direction of the first nip so that a longitudinal edge of the baffle plate is moved toward the first nip. The projecting leading end of the web is folded or bent about the longitudinal edge of the plate so that the web is adjacent to both sides of the baffle plate, a web tail being formed which extends away from the longitudinal edge of the baffle plate. The baffle plate now introduces the portion of the web folded around the longitudinal edge into the nip. A suitably shaped guide member may assist this insertion. Upon further rotation the web end is pressed against the core by the following web so that the first winding is completed. After several revolutions the web end is sufficiently secured to the core so that the winding operation is performed in the usual way, e.g. with the aid of a press roll biasing the core against the bearer drums.

The threading technology according to this state of the art forms a thickness step of three layers of fibrous material web where the web for the first time overlaps its end inserted in the nip. It has turned out that especially in the case of thicker fibrous material webs at a position corresponding to this point, breaks in the web can occur even later in the wound product. Hereinafter the terms of fibrous material web and web will be used synonymously for the fibrous material web.

SUMMARY OF THE INVENTION

It is the object of the invention to suggest a method of threading a thick fibrous material web into a winder as well as an apparatus for threading a thick fibrous material web into a winder by which the aforementioned drawbacks are avoided. The thickness of the thick fibrous material web is more than 0.5 mm.

In accordance with the invention, the method of adhesive-free threading of a thick fibrous material web for winding onto a winding body comprises the following steps of: diverting the fibrous material web in the circumferential direction of the winding body, guiding the fibrous material web with its unfolded leading edge ahead in the direction of a nip formed between the winding body and a roll, and catching the leading edge of the fibrous material web by interaction with the fibrous material web and/or the winding body.

By the method according to the invention, the web is introduced with the leading edge ahead or first guided to the nip in which the fibrous material web is already provided. The arriving web assists catching the leading edge of the web into the nip and then clamps the foremost end of the web to the core. The interaction may consist in the fact that the arriving web gets into frictional engagement with the winding body and/or with the arriving web; it may also consist in the fact that the web end is clamped or pinched in the vicinity of the nip between the web and the winding body. If the web is held at the core, the web can be wound.

Since no fold is formed, the afore-described step of thickness only has the height of two web layers when the leading edge of the web is superimposed on the core by the following web. The risk of web breaks is reduced. Therefore no adhesive tape is required.

The invention can be used in winders making use of winding cores. The method can also be applied when a winding shaft is used (i.e. no winding core being retained in the wound product is provided) onto which the fibrous material web is wound. In order to cover these two forms, a winding body which explicitly includes both winding cores and winding shafts is defined in the claims. In the following description the terms of winding body, winding core and core are used synonymously.

The method according to the invention can be applied to an apparatus where the winding body forms a single nip with a roll.

Preferably the winding apparatus can form two nips with the winding body, wherein then in the method preferably the fibrous material web is deflected after leaving a further nip formed between the winding body and a further roller.

Preferably the fibrous material web first passes through the nip and then through the further nip; i.e. the leading edge of the web is supplied to the nip mentioned first here.

Preferably, upon diverting, the leading edge of the fibrous material web is pushed toward the nip in one direction.

During diverting, preferably a tensile load is applied to the fibrous material web in the circumferential direction of the winding body. By this course of action, the fibrous web is tightened around the core and thus smoothly contacts the core.

Furthermore, diverting the fibrous material web in the direction of the nip is preferably assisted by an auxiliary nip. The auxiliary nip can be generated by an auxiliary pressing means which presses the unfolded leading edge of the fibrous material web toward the nip until the leading edge is caught, wherein the auxiliary pressing means is adapted to hold the fibrous material web tightly around the winding body.

Preferably, to this end the auxiliary pressing means can advance or decelerate the fibrous material web. Alternatively or in addition the rotation of the winding body can be accelerated or decelerated in order to stretch the fibrous material web tight.

Preferably the winding body can be rotated in a winding bed formed by two bearer drums, a nip being formed between the winding body and each bearer drum, the fibrous material web passing through both nips and the auxiliary pressing means being adapted to act upon the fibrous material web above the two nips and between two vertical planes each of which includes a nip. It is described here that the auxiliary pressing means by which the diversion and the guiding to the nip are assisted can be arranged in the intermediate space between the two bearer drums. The auxiliary pressing means is preferably movable. It is of advantage when the auxiliary pressing means can be moved out of the intermediate space.

The fibrous material web can preferably be inserted, after passing the two nips with its unfolded leading edge ahead, by means of the auxiliary pressing means between the subsequent fibrous material web and the winding body so as to be caught by the nips.

After the fibrous material web has been guided for several revolutions of the winding body during the threading operation, upon winding the fibrous material web can be pressed against the winding body by a press roll different from the auxiliary pressing means. In winding operations such press rolls are used to control the winding hardness and/or to ensure a safe catching of the winding body for its rotation along with a rotating drum, which can also be two rotating bearer drums.

There is a plurality of techniques and means for guiding a fibrous material web. As regards the present method, preferably the following options for guiding the fibrous material web are applicable: The leading edge of the fibrous material web can be caught by means of sliding contact with a mechanical guide and/or by means of one or more air jets. The fibrous material web can be diverted by means of rolling contact with one or more rolls, by means of sliding contact with a mechanical guide, by means of an auxiliary nip and/or by means of one or more air jets and the fibrous material web can be bent into a shape approached to the circumference of the core by means of rolling contact with one of more rolls, by means of sliding contact with a mechanical guide, by means of an auxiliary nip and/or by means of one or more air jets.

In the aforementioned techniques especially the rolling contact between the roll or rolls and the web can be brought about by adjustable pressure. Such a solution can be realized, for instance, by the adjustable auxiliary pressing means.

Preferably it can be provided that the threaded fibrous material web is tightened by increasing the diameter of the winding body. To this end, the winding body can be equipped, for instance, with hydraulic or pneumatic means so that the diameter of the winding body is adjustable. Mechanical constructions by which this can be achieved are equally possible.

An apparatus according to the invention for adhesive-free threading of a thick fibrous material web for winding onto a winding body includes a diverting means for diverting the fibrous material web in the circumferential direction of the winding body and a guide means or device for guiding the fibrous material web with its unfolded leading edge ahead in the direction of a nip formed between the winding body and a drum, wherein the leading edge of the fibrous material web is caught when an interaction with the fibrous material web and/or the winding body takes place.

As explained in the beginning, in the apparatus according to the invention the method according to the invention is realized by a diverting means and a guide means. The diverting means and the guide means are configured to lead the unfolded leading end of the fibrous material web in the direction of the nip between a drum and the winding body. The fibrous material web has a particular stiffness which is sufficient to guide the unfolded end freely over a certain distance so that it is not necessary to stiffen the leading end by folding. The distance over which the unfolded leading end is guided is preferably adjusted to the stiffness of the web.

Preferably the diverting means includes drive means so as to push the leading edge of the fibrous material web toward the nip. Preferably the drive means of the diverting means are designed so that during diverting they can apply a tensile force to the fibrous material web in the circumferential direction of the winding body.

It is a possible configuration that the diverting means includes an auxiliary pressing means forming an auxiliary nip at the winding body. The auxiliary pressing means preferably comprises a drive and/or a brake so as to press the unfolded leading edge of the fibrous material web in the direction of the nip and/or to keep the fibrous material web tight around the winding body.

In the apparatus the diverting means and the guide means are preferably arranged in the moving direction of the fibrous material web behind another nip so as to divert the fibrous material web when it leaves the further nip formed between the winding body and a further drum.

Preferably the winding body is arranged in a winding bed formed of two bearer drums and is rotated there, wherein a nip is formed between the winding body and each bearer drum, the fibrous material web being adapted to pass both nips and the auxiliary pressing means being adapted to be arranged movably above the two nips and between two vertical planes each including a nip.

The auxiliary pressing means preferably includes an adjustable friction means so as to apply a tensile force in the circumferential direction of the winding body to the fibrous material web upon diverting.

The friction means preferably includes one or more optionally resilient roll or rolls the axis or axes of which are aligned in parallel to the axis of rotation of the winding body. An adjusting means can be operatively connected to the friction means so as to adjust the pressure of the friction means against the fibrous material web or else to vary the same during the threading operation.

In an advantageous configuration the guide means comprises at least one guide plate disposed in the direction of movement of the fibrous material web, behind the diverting means and the guide plate is gradually bent in parallel to the circumferential shape of the winding body.

Preferably the guide means is movable and the leading edge of the at least one guide plate of the guide means can closely approach the nip. Closely in this context means a value dependent on the type of fibrous material web or on the characteristics thereof which at any rate has to be dimensioned such that a web portion freely projecting from the guide plate in the direction of the nip is stiff enough to be inserted into the nip or to be guided so closely to the web that it is caught by the nip. The value preferably lies within the range of from 1 mm to 20 mm.

Preferably the at least one guide plate exhibits a comb-like configuration having teeth extending in the moving direction of the web. The guide means furthermore can include rolls which are or can be arranged between the teeth of the comb-like guide plate. In order to reduce the weight and possibly to arrange additional sliding elements the at least one guide plate can have a comb-like configuration having tines extending in the moving direction of the web. It is possible that the guide means further includes rolls that are or can be arranged between the teeth of the comb-like guide plate.

Preferably a catching means in the form of one or more plates and/or air jets is associated with the diverting means so as to guide the leading edge of the fibrous material web into the sphere of influence of the diverting means which includes e.g. the auxiliary pressing means.

It can preferably be provided that the winding body is equipped, for instance, with hydraulic or pneumatic means by which the diameter of the winding body is adjustable. Especially hoses that can be filled or pumped up can be provided. Only minor increases in the diameter are required to tighten the threaded fibrous material web over the circumference of the winding body. Equally mechanical designs, especially including meshing cones or the like, are possible in order to achieve this target.

Of preference, the device has a press roll movable independently of the diverting means and/or the guide means by which the fibrous material web can be pressed against the core during the winding operation. Such press roll is adapted to assist both the power transmission for rotating the core and to control the winding tightness.

Further objects, features and advantages of the invention will be apparent from the following detailed description when taken in conjunction with the accompanying drawings.

BRIEF DESCRIPTION OF THE DRAWINGS

Hereinafter the invention will be described in detail by way of a strongly schematized embodiment. For this purpose, the enclosed figures are referred to in which.

DESCRIPTION OF THE PREFERRED EMBODIMENTS

Figure 1:
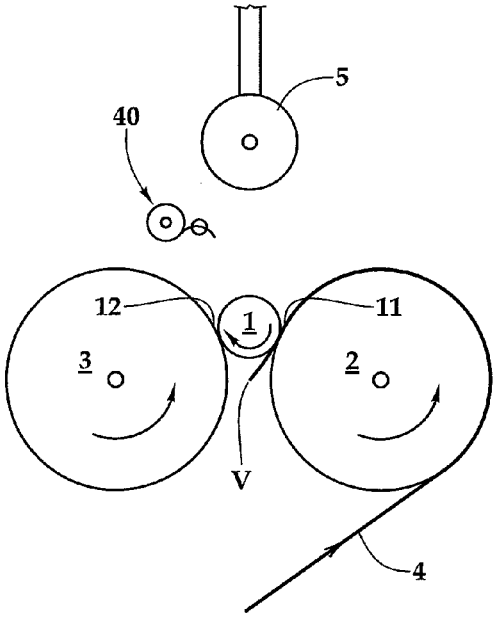
FIG. 1 shows in a strongly schematized manner a winding apparatus in which the threading operation of a fibrous material web has started.

FIG. 1 illustrates two bearer drums 2 and 3 on which a winding body, in this case a winding core 1 forming the later center of a wound fibrous material web 4, is supported. The bearing points of the core 1 on the bearer drums 2 and 3 are linear contacts which are to be referred to as nip in the following. The nip formed between the core 1 and the bearer drum 2 is denoted with 11 while the nip between the core 1 and the bearer drum 3 is denoted with 12. Furthermore, FIG. 1 shows a fibrous material web 4 guided around the bearer drum 2 coming from the right bottom and the leading edge V of which is guided through the nip 11.

FIG. 1 further shows a press roll 5 above the core 1 to be used for the later winding operation and a threading device 40 in a strongly schematized representation above the nip 12.

The bearer drums 2 and 3 shown in FIG. 1 rotate anticlockwise, the core 1 being rotated clockwise by the bearer drums 2 and 3. By this rotation also the fibrous material web 4 is conveyed through the nip 11.

Figure 2:
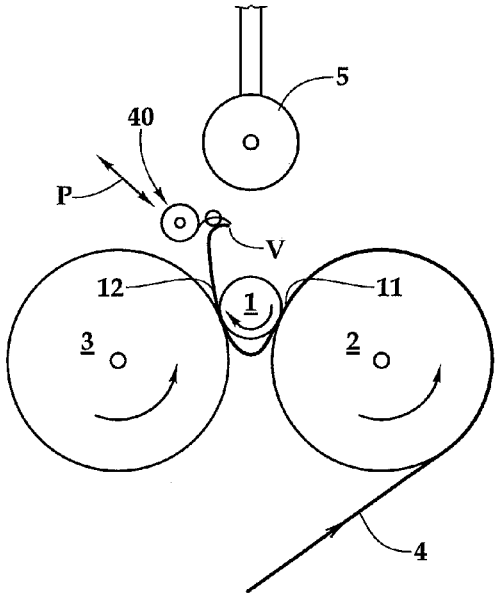
FIG. 2 shows the continued threading operation in the winding apparatus according to FIG. 1.
Figure 8:
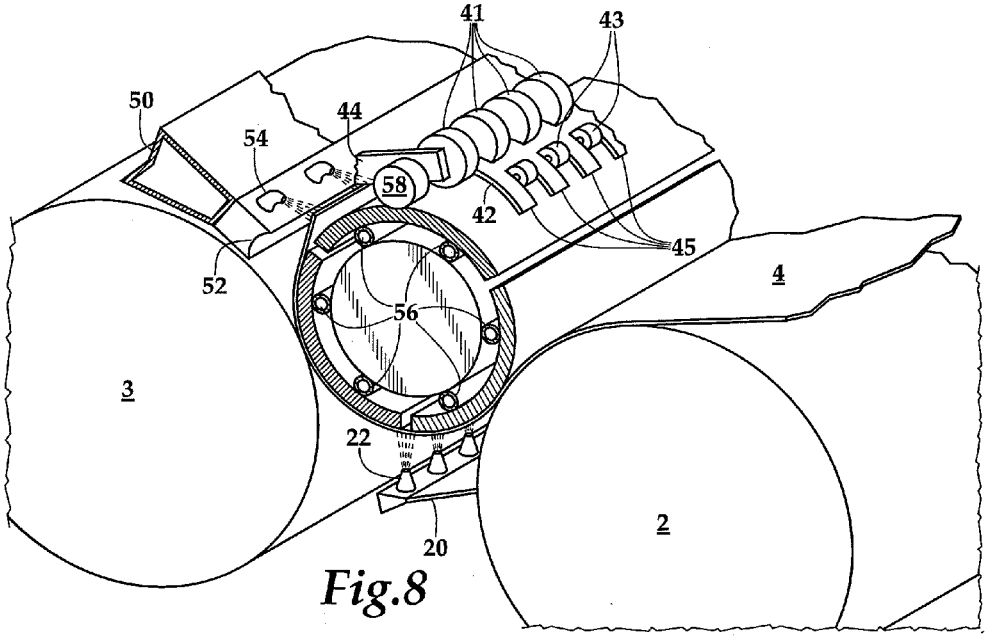
FIG. 8 is a schematic axonometric view of the apparatus of FIG. 5 showing the threading device engaging the winding body, and additional structures.

FIG. 2 shows the continued threading operation started in FIG. 1. The same reference numerals denote also the same elements in this figure. The fibrous material web 4 has passed the nip 11, has been collected by a device not shown in detail and diverted so that the leading edge V of the fibrous material web 4 has been inserted in the nip 12 formed between the core 1 and the bearer drum 3. The diverting operation below the core 1 in FIG. 2 can be effectuated by a divert device, for instance, a doctor blade 20, a deflector plate (not shown) or else an air jet device 22 as shown in FIG. 8.

Above the bearer drum 3 there is shown a threading device 40, wherein the arrows P indicate it to be movable. The threading device 40 is shown only very schematically and is illustrated in more detail with reference to FIG. 5.

When the fibrous material web 4 has passed the nip 12 with its leading edge, the leading edge V contacts the threading device 40. By this threading device the leading end of the fibrous material web 4 is guided with the leading edge V ahead in the circumferential direction of the core 1 so that the position of the fibrous material web 4 shown in FIG. 3 is brought about.

Figure 3:
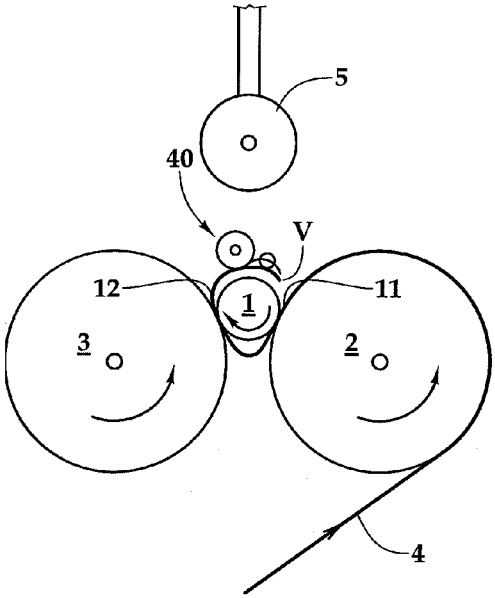
FIG. 3 shows a state in the threading operation in a winding apparatus o according to FIG. 1 shortly before threading is completed.

As is visible from FIG. 3, the threading device 40 has been clearly moved to the center of the winding apparatus and has approached the core 1. In this way the fibrous material web 3 is controlled or guided with its leading edge V ahead in the direction of the nip 11. Being further advanced by the rotation of the bearer drums, the leading edge V of the fibrous material web 4 is moved even more closely to the nip 11. If the leading edge V is inserted into the nip 11 so far that an interaction (for instance an entraining frictional contact) is reached with the trailing fibrous material web 4, the leading edge V of the fibrous material web 4 is pulled into the nip 11. At this moment the subsequent fibrous material web 4 pinches the leading edge V to the core 1 so that the fibrous material web 4 is fixedly held on the winding core 1 and the winding operation can start.

Figure 4:
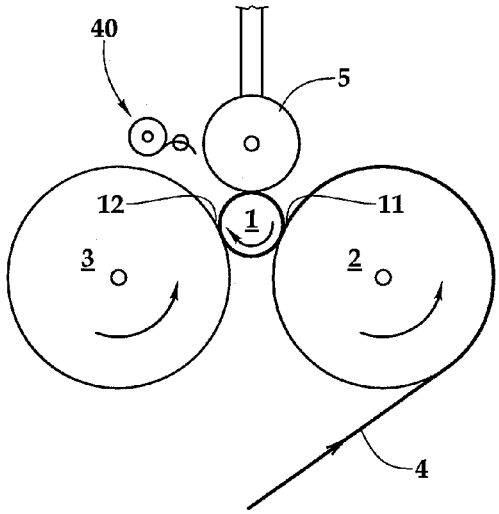
FIG. 4 shows the start of winding after threading in the winding apparatus according to FIG. 1.

Preferably the core is further rotated for several times during threading so that the beginning of the fibrous material web 4 is wound around the core 1 for several times, before, as illustrated in FIG. 4, the press roll 5 urges the fibrous material web 4 from above, presses against the core 1 and thus fixedly presses the core toward the bearer drums 2 and 3. By this press roll 5 the winding tightness of the wound product being formed around the core 1 can be systematically influenced.

Figure 5:
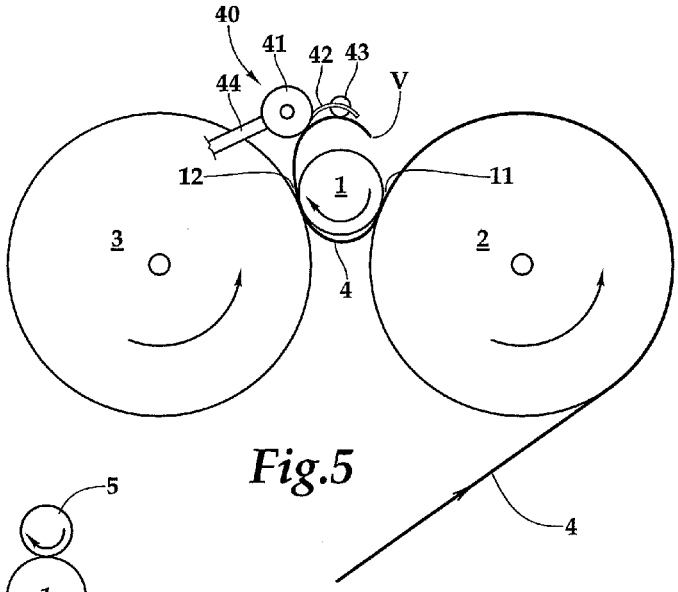
FIG. 5 schematically shows several details of the threading operation in the winding apparatus according to FIG. 1.

FIG. 5 is a somewhat enlarged schematized representation of the elements which can be found in a threading device 40. FIG. 5 only indicates the bearer drums 2 and 3 between which the core 1 is held and is adjacent to the nips 11 and 12 at the two bearer drums 2 and 3. The fibrous material web 4 is guided with its leading edge V through the two nips 11 and 12. The threading device 40 includes a diverting roll 41 as auxiliary pressing means for forming an auxiliary nip, a guide plate 42 and guide rolls 43. These elements are held at rods 44 only symbolically reproduced by a simple bar, the rods 44 being designed to bring about the position of both the diverting roll 41 and the other guiding elements 42 and 43 with respect to the core 1 and with respect to the bearer drums 2, 3 in a desired and possibly independent manner. This means that it is not only a simple reciprocating or swivel movement which is meant but the rods 44 are adapted to carry out also more complicated moving operations.

So, although this is not shown here, the diverting roll 41 can form, with the fibrous material web 4 in between, an auxiliary nip vis-à-vis the core 1. In this auxiliary nip the web can be accelerated or delayed so that, on the one hand, the web is laid tightly around the winding core and, on the other hand, is moved or pushed toward the nip 11 by a forced movement.

FIG. 5 shows that the fibrous material web 4 meshes with the diverting roll 41 and that the fibrous material web 4 is further guided by the guide plate 42. The guiding is aimed at guiding the leading edge V, as explained above, that far into the nip 11 until the leading edge is also pulled into the nip 11 by the subsequent fibrous material web. In order to assist this and to permit smooth sliding of the leading end of the fibrous material web 4 past the guiding elements 42 and 43, the guide plate 42 may have a comb-like shape as shown in FIG. 8, the guiding rolls 43 being arranged between the comb teeth 45 formed in this way. It is also possible to arrange or form the guiding rolls 43 to be movable or adjustable vis-à-vis the guide plate 42.

The diverting roll 41 usually can be driven, namely anticlockwise in FIG. 5. Hence by the diverting roll 41 not only the caught leading edge V of the fibrous material web 4 can be diverted toward the guide plate 42, but the diverting roll 41 is also configured such that the rotating diverting roll 41 can catch the fibrous material web 4 by frictional contact. In the position shown in FIG. 5 this is possible to a limited extent only, but it is obvious that as stated already before the diverting roll 41, when further approached to the core 1, can form an additional nip with the core 1 in which the fibrous material web 4 can be conveyed.

Preferably the number of revolutions of the diverting roll 41 is selected such that the circumferential speed thereof is slightly higher than that of the core 1 so that the fibrous material web 4 leaving the nip 12 is tightened on the core 1 (this is not shown in FIG. 5). The fibrous material web 4 tightly placed on the core 1 moves to the nip 11 in the described manner and is conveyed there together with the subsequent fibrous material web through the nip 11 and the leading edge of the fibrous material web 4 is thus safely held.

In the described method of the apparatus a lot of configurations can be made. For instance, the diverting roll 41 can be spring-biased so as to exert a defined force onto the fibrous material web 4 in the contacting position against the core 1. The diverting roll 41 can also have a soft surface so that the spring action of this elastically deformable surface corresponds to a resilient suspension of the diverting roll 41. There can also be used a type of foamed rubber roller.

The guide plate 42 can be designed to be comb-like, but is it also possible to make use of a simple plate or a multi-split plate extending in the transverse direction of the machine. The plate need not be made of sheet metal, of course, but can be made of any type of suitable material. The guide plate does not need to be thin but it can be in the form of a suitably configured body having extensions by which the guiding rolls 43 are held as shown in FIG. 8. The guide plate 42 can also be in the form of a guiding body including the diverting roll 41 as well as a guiding face and guiding rolls 43, where appropriate.

Figure 6:
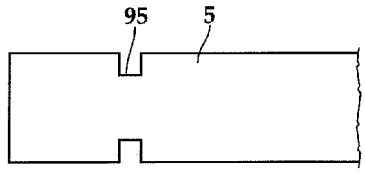
FIG. 6 schematically shows an example of a press roll for the threading operation.

In FIG. 6 is schematically shown a pressure roll 5 provided with means 95 to create the holding nip for the leading edge i.e. tail beginning of the fiber web when threading for winding. The pressure roll 5 is provided with, for example grooves 95, that provide for holding the tail of the web.

Figure 7:
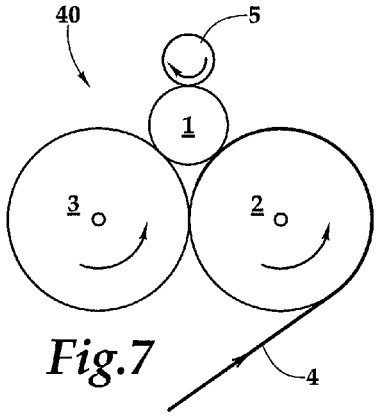
FIG. 7 schematically shows an example for the threading operation using a press roll according to FIG. 6.

As shown in FIG. 7 the pressure roll 5 provides for the holding nip on the top of the core 1 when the tail beginning is directed around the core 1 in the beginning of winding of the fiber web 4 in a two drum 2, 3, winder. Thus the holding means 95 in the pressure roll 5 accomplish catching the leading edge of the fibrous material web by interaction with the fibrous material web and/or the winding body 1.

The winding body 1 is equipped, for instance, with hydraulic or pneumatic means by which the diameter of the winding body is adjustable. Especially hoses 56 that can be filled or pumped up can be provided as shown schematized in FIG. 8. Only minor increases in the diameter are required to tighten the threaded fibrous material web over the circumference of the winding body. Equally mechanical designs, especially including meshing cones or the like, are possible in order to achieve this target.

Preferably as shown in FIG. 8 a catching device 50 in the form of one or more plates 52 and/or air jets 54 is associated with the diverting means formed by the diverting roll or the auxiliary pressing roll 41 so as to guide the leading edge V of the fibrous material web 4 into the sphere of influence of the auxiliary pressing roll 41 or pressing means. As shown in FIG. 8 the divert or auxiliary pressing roll 41 incorporates a drive and/or a brake 58 so as to press the unfolded leading edge of the fibrous material web in the direction of the nip and/or to keep the fibrous material web tight around the winding body.

Although not shown here, such winding apparatus as described in the foregoing is frequently used in connection with a cutting device or a longitudinal cutter. In such longitudinal cutter large rolls of a wide web are cut into individual webs, and these webs are then wound in the shown winding apparatus, for instance. In such apparatus the web is usually processed having a leading edge extending in the transverse machine direction and extending over the entire web width. But it is also possible that the leading edge of the web is cut to be slanted or pointed so that the threading is to start with the tip of the web ahead. In this case, too, the method described here and the apparatus described here are applicable.

When the method described here and the apparatus described here are used in connection with a longitudinal cutter, then threading by a leading edge extending in the transverse direction of the web over the entire web width is advantageous, because the longitudinal cutter can supply right away pre-cut webs to the winder so that the individual wound products are formed in axial direction completely separately from each other and later no wearisome separation of the individual wound products is required.

Since in the method described here no folded leading edge is covered in the nip by another web layer so that three webs are stacked at this position, this method is especially suited for the winding of thick fibrous material webs; but it can also be used for fibrous material webs of conventional thickness. There is no adhesive tape or other adhesive required, either.

In this application everything is understood to be a thick fibrous material web which is covered by the terms of paper, paperboard, cardboard etc. so that no restrictions are made in this respect. Preferably, the fibrous material web can also be a pulp web. The thickness of the web can be more than 0.5 mm, it can especially also be more than 0.7 mm.

It is understood that the invention is not limited to the particular construction and arrangement of parts herein illustrated and described, but embraces all such modified forms thereof as come within the scope of the following claims.

We claim:

1. A method of adhesive-free threading of a thick fibrous material web, especially a pulp web, for winding around a winding body in a continuous operation, comprising the steps of:

supporting the winding body between a first bearer drum forming a first nip with the winding body, and a second bearer drum forming a second nip with the winding body, wherein the first bearer drum and the second bearer drum define an open gap therebetween;

wrapping the fibrous material web about the first bearer drum in the continuous operation;

passing the fibrous material web wrapped on the first bearer drum into the first nip formed between the first bearer drum, and the winding body.

deflecting the fibrous material web upwardly through the second nip formed between the winding body and the second bearer drum;

wherein the second nip defines a threading side of the winding body opposite the first nip.

diverting the fibrous material web in a circumferential direction defined by the winding body, and away from the second nip with a threading device;

guiding the fibrous material web with an unfolded leading edge in a direction toward the first nip formed between the winding body and a first bearer drum; and wherein the step of guiding is performed only from the threading side of the winding body with the threading device which moves to engage the fibrous material web, the threading device catching the leading edge of the fibrous material web by interaction with the fibrous material web and the winding body with a diverting roll and a guide plate, and directing the fibrous material web in to the first nip.

2. The method of claim 1 wherein during the diverting of the fibrous material web the unfolded leading edge of the fibrous material web is pushed in a direction toward the first nip by driving the diverting roll to rotate so the diverting roll pushes the fibrous material web around the winding body and under the guide plate into the first nip.

3. The method of claim 2 wherein during the diverting of the fibrous material web a tensile stress is applied to the fibrous material web in the circumferential direction defined by the winding body the tensile stress effected by rotation of the diverting roll.

4. The method of claim 2 wherein the step of diverting of the fibrous material web and pushing the fibrous material web in the direction of the nip is assisted by guide rolls mounted to the guide plate which form an auxiliary nip which engages the fibrous material web.

5. The method of claim 4 wherein the auxiliary nip is produced by using an auxiliary pressing device;

wherein the auxiliary pressing device presses the unfolded leading edge of the fibrous material web in the direction of the nip until the leading edge is caught in the nip; and wherein the auxiliary pressing device holds the fibrous material web tightly around the winding body.

6. The method of claim 5 further comprising stretching the fibrous material web tight using the auxiliary pressing device or the winding body, by advancing or decelerating the fibrous material web with the auxiliary pressing device or accelerating or decelerating the rotation of the winding body.

7. The method of claim 5 wherein during the adhesive-free threading of the fibrous material web, the fibrous material web is guided for several revolutions of the winding body before the fibrous material web is pressed against the winding body during winding by a press roll different from the auxiliary pressing device.

8. The method of claim 1 further comprising rotating the winding body in a winding bed formed by the first drum, and a second drum;

wherein a first nip is formed between the winding body and the first drum;

wherein a second nip is formed between the winding body and the second drum, and further comprising the step of passing the fibrous material web through both the first nip and the second nip and wherein the auxiliary pressing device acts upon the fibrous material web above the first and second nips and between a first vertical plane passing through the first nip, and a second vertical plane passing through the second nip.

9. The method of claim 8 wherein after passing through both the first nip and the second nip the fibrous material web is inserted with its unfolded leading edge oriented first by the auxiliary pressing device, into the first nip between the fibrous material web wrapping the first drum and the winding body so that the unfolded leading edge is caught by the first nip.

10. The method of claim 1 wherein the step of diverting the fibrous material web further comprises:

catching the leading edge of the fibrous material web by a sliding contact with a mechanical guide, or catching the leading edge of the fibrous material web by at least one air jet;

by diverting with: a rolling contact with at least one roll, or an auxiliary nip, or by a sliding contact with a mechanical guide, or at least one air jet; and by bending the fibrous material web into a shape approached to the circumference of the winding body by rolling contact with at least one roll, or sliding contact with a mechanical guide, or an auxiliary nip or at least one air jet.

11. The method of claim 10 wherein the rolling contact pressure between the at least one roll and the web or the pressure prevailing in the auxiliary nip is adjustable.

12. The method of claim 1 wherein the threaded fibrous material web is tightened by increasing the diameter of the winding body.

13. An apparatus for adhesive-free threading of a thick fibrous material web, especially a pulp web, for winding around a winding body, comprising:

a winding body;

a first bearer drum;

a second bearer drum;

wherein the first bearer drum is spaced from the second bearer drum to define a gap therebetween, the winding body being held over the gap;

wherein the winding body forms a first nip with the first bearer drum, and a second nip with the second bearer drum, the first nip defining a first side of the winding body, and the second nip defining a second side of the winding body;

wherein the fibrous material web is wrapped over the first bearer drum and extends downwardly through the first nip;

a diverting device below the winding body and extending into the gap, the diverting device arranged to guide the fibrous material web upwardly through the second nip;

a threading device arranged to extend in a first direction from the second side toward the first side of the winding body;

a diverting device forming a part of the threading device and arranged to divert the fibrous material web in a circumferential direction defined by the winding body toward the first nip, and a guiding device forming a part of the threading device, the guiding device for guiding the fibrous material web with an unfolded leading edge ahead in a direction toward the first nip, so that the leading edge of the fibrous material web is caught in the first nip by an interaction with the fibrous material web as it wraps the first bearer drum.

14. The apparatus of claim 13 wherein the diverting device includes a drive arranged to push the leading edge of the fibrous material web in the direction toward the first nip.

15. The apparatus of claim 14 wherein the diverting device drive is arranged to apply a tensile force in a circumferential direction defined by the winding body to the fibrous material web.

16. The apparatus of claim 15 further comprising an auxiliary pressing device forming an auxiliary nip at the winding body.

17. The apparatus of claim 16 wherein the auxiliary pressing device includes a drive or a brake so that the auxiliary pressing device is arranged to press the unfolded leading edge of the fibrous material web toward the first nip or to hold the fibrous material web tightly around the winding body.

18. The apparatus of claim 16 wherein the auxiliary pressing device is movably arranged above the first nip and the second nip and between a first vertical plane passing through the first nip, and a second vertical plane passing through the second nip.

19. The apparatus of claim 16 wherein the auxiliary pressing device has a press roll which forms an adjustable friction device for applying a tensile force in the circumferential direction of the winding body to the fibrous material web.

20. The apparatus of claim 19 wherein the press roll has an axis which is aligned parallel to an axis of rotation defined by the winding body.

21. The apparatus of claim 13 wherein the guiding device includes at least one guide plate disposed in a running direction of the fibrous material web with respect to the diverting device, said at least one guide plate being bent in parallel to the circumferential shape of the winding body.

22. The apparatus of claim 21 wherein the guiding device is mounted for movement such that the trailing edge of the at least one guide plate of the guiding device can be brought to within 1 to 20 mm of the nip.

23. The apparatus of claim 21 wherein the at least one guide plate has a comb-like shape including teeth extending in the running direction of the web.

24. The apparatus of claim 23 wherein the guiding device furthermore includes rolls which are arranged between the teeth of the comb-like guide plate.

25. The apparatus of claim 13 further comprising a catching structure having at least one plate or air jet provided to guide the leading edge of the fibrous material web into the sphere of influence of the diverting device.

26. The apparatus of claim 13 wherein the winding body includes expandable hoses so as to tighten the threaded fibrous material web by increasing the diameter of the winding body.

27. The apparatus of claim 13 further comprising a press roll movable independently of the diverting device or the guiding device by which during the winding operation the fibrous material web can be pressed against the winding body.

28. An apparatus for adhesive-free threading of a thick fibrous material web, for winding around a winding body, comprising:

a first winding drum;

a second winding drum forming a winding bed with the first winding drum;

wherein the thick fibrous material web has an unfolded leading edge and is at least 0.7 mm thick;

wherein the winding body is adhesive-free and is arranged to rotate in the winding bed and wherein a first nip is formed between the winding body and the first drum, and a second nip is formed between the winding body and the second drum and wherein the fibrous material web wraps a portion of the first drum and extends through the first nip and extends under the winding body to the second nip, and from the second nip the fibrous material web extends over the winding body so that the unfolded leading edge enters the first nip from above;

a diverting devise including a diverting roll in driven relation to a drive, the diverting roll engaging the thick fibrous material web against the winding body so that the drive applies tension to the thick fibrous material web in a circumferential direction defined by the winding body, wherein the diverting roll is arranged to divert the fibrous material web in the circumferential direction after the fibrous material web passes through the second nip;

at least one guide plate disposed in a running direction of the fibrous material web with respect to the diverting device, the at least one guide plate being bent in parallel to the circumferential shape of the winding body, wherein the at least one guide plate has a comb-like shape including teeth extending in the running direction of the web and rolls are arranged between the teeth; and wherein the guiding plate is for guiding the fibrous material web with the unfolded leading edge toward the first nip, so that the unfolded leading edge of the fibrous material web is caught in the nip by an interaction with the fibrous material web wrapping the first drum and in nipping engagement with the winding body.

* * * * *